US005917778A

United States Patent [19]

James et al.

[11] Patent Number: 5,917,778

[45] Date of Patent: Jun. 29, 1999

[54] GEOGRAPHICAL CHRONOLOGICAL DEVICE

[75] Inventors: John I. James, Knoxville; Thomas C. Innes; Lois A. Loy, both of Heiskell; Martha C. James, Knoxville, all of Tenn.

[73] Assignee: Cube-I, L.L.C., Heiskell, Tenn.

[21] Appl. No.: 08/937,776

[22] Filed: Sep. 25, 1997

[51] Int. Cl.[6] ..... G04B 19/22; G04B 19/26

[52] U.S. Cl. ..... 368/17; 368/27

[58] Field of Search ..... 368/15–17, 21, 368/27

[56] References Cited

U.S. PATENT DOCUMENTS

| | | | |
|---|---|---|---|
| 557,173 | 3/1896 | Thompson . | |
| 594,410 | 11/1897 | Margolis . | |
| 635,268 | 10/1899 | Osse . | |
| 862,884 | 8/1907 | Connor . | |
| 1,045,304 | 11/1912 | Luporini . | |
| 1,378,085 | 5/1921 | Balch . | |
| 2,615,298 | 10/1952 | Ferrari . | |
| 3,486,322 | 12/1969 | Abend et al. | 58/43 |
| 3,611,704 | 10/1971 | Guintos | 58/44 |
| 4,502,789 | 3/1985 | Heath | 368/27 |
| 4,579,460 | 4/1986 | Shannon | 368/27 |
| 4,759,002 | 7/1988 | Cash | 368/15 |
| 5,146,436 | 9/1992 | Wright | 368/21 |
| 5,197,043 | 3/1993 | Strader | 368/27 |
| 5,448,532 | 9/1995 | Kataoka et al. | 368/10 |
| 5,457,663 | 10/1995 | Mejaski | 368/15 |
| 5,508,979 | 4/1996 | Eisenegger | 368/15 |

FOREIGN PATENT DOCUMENTS

| | | | |
|---|---|---|---|
| 8070 | of 1910 | United Kingdom | 368/27 |

*Primary Examiner*—Vit Miska
*Attorney, Agent, or Firm*—Luedeka, Neely & Graham, PC

[57] ABSTRACT

A geographical chronological device which simultaneously indicates the time in multiple cities or countries, and displays fluctuations in day or night in a geographic location. The earth clock has a semi-transparent world map depicting a polar planetary projection of the world from the north or south pole. An adjustable shadow disk is disposed adjacent to and partly visible through the semi-transparent world map. The shadow disk has a periphery with time indicia disposed about the periphery. The adjustable shadow disk has an adjustable dark portion to indicate night and an adjustable light portion to indicate day. The dark and light portions adjust to indicate relatively greater or lesser night and day according to the change in seasons. A clock movement provides relative movement between the semi-transparent world map and the adjustable shadow disk.

20 Claims, 6 Drawing Sheets

GEOGRAPHICAL CHRONOLOGICAL DEVICE

FIELD

This invention relates to chronographical devices. More particularly the invention relates to clocks which simultaneously indicate the time in multiple geographic regions of the world.

BACKGROUND

Some clocks display the time in multiple cities or countries simultaneously. Such clocks typically indicate time in hours minutes and seconds, and may have multiple digital or analog displays, each display indicating the time in a different geographical area. Other clocks may incorporate a geographical display on the clock and provide a pointer which indicates the time in various geographical locations.

Although it is beneficial to know the time in hours, minutes and seconds, it is also beneficial to know whether it is day or night in a given geographical area. The ability to indicate the seasonal changes in day and night in a geographical location may be very useful. For example, it is important to know seasonal variations of day and night to understand agricultural growing and dormant cycles and to understand cultural customs which are based on seasonal fluctuations in day and night.

Time displayed in hours does not distinguish between day and night. Some clocks provide a shaded portion on the face of the clock. Night is indicated when the time pointer sweeps through the shaded portion of the clock face. Day is indicated when the time indicator sweeps through the portion of the clock face that is not shaded.

These types of day and night indications may be moderately accurate for geographical areas which do not experience very distinguishable shifts in day or night during seasonal variations, such as geographical locations situated near the equator. However, most locations in the world experience great fluctuations in the relative amounts of day and night depending on variations in seasons. This is especially true in geographic areas located in the extreme north and south. These areas experience weeks or months of continuous day or night. Therefore, it is difficult to indicate the relative amounts of day and night in these extreme locations based on a stationary shaded portion of a clock.

The relationship between the earth's rotation, time and seasonal variations in day and night can be a difficult concept to grasp. A device which demonstrates the seasonal variations in various geographical regions in respect to time and the earth's rotation could facilitate understanding of this concept.

What is needed is a time indicating device which indicates the time in multiple geographic locations and overcomes the problem of indicating the relative amount of day and night according to seasonal variations.

SUMMARY

The above and other needs are met by a geographical chronological device which simultaneously indicates the time in multiple cities or countries, and displays fluctuations in day or night in a geographic location. The geographical chronological device has a semi-transparent world map depicting a polar planetary projection of the world from the north or south pole. An adjustable shadow disk is disposed adjacent to and partly visible through the semi-transparent world map. The shadow disk has a periphery with time indicia disposed about the periphery. The adjustable shadow disk has an adjustable dark portion to indicate night and an adjustable light portion to indicate day. The dark and light portions adjust to indicate relatively greater and lesser night and day according to the change in seasons. A clock movement provides relative movement between the semi-transparent world map and the adjustable shadow disk.

By providing an adjustable shadow disk the geographical chronological device shows relative amounts of day and night in a geographic location according to changes in the seasons. This is especially beneficial as an instructional aid for teaching the variations in day and night according changes in the seasons. The clock movement can be quickly rotated in the housing in order to demonstrate changes in night and day. Perhaps more advantageously, the adjustable shadow disk can be quickly adjusted in order to show changes in the amount of day and night a geographical region experiences. This kind of demonstration assists in teaching students not only about variations in day and night according to seasons within their own geographic location, but in respect to other regions of the world. This kind of hands-on example is also beneficial for illustrating why different regions of the world have different agricultural cycles and produce. The device also clearly illustrates the phenomenon of the Midnight Sun, a concept which can be difficult to grasp.

In preferred embodiments, the geographical chronological device has a clock housing having a perimeter. The adjustable shadow disk also has sliding portions for selectively adjusting the adjustable light portion and the adjustable dark portion. The sliding portions are connected to tabs for selectively sliding the sliding portions to indicate relatively greater and lesser day and night according to changes in the seasons. The clock housing has openings for accessing the tabs. The clock housing contains a lip for removably hanging the geographical chronological device.

Further, the clock movement is rotatably attached to the clock housing so that the clock movement may be selectively rotated relative to the clock housing, for quickly adjusting times for teaching, instructional and demonstrational purposes. A light is disposed within and at the perimeter of the clock housing for providing light to the adjustable shadow disk. A light shield is disposed about at least a portion of the periphery of the adjustable shadow disk, and selectively blocks the light from the adjustable dark portion of the adjustable shadow disk, and selectively passes the light to the adjustable light portion of the adjustable shadow disk.

In alternative embodiments, the adjustable light portion of the adjustable shadow disk either emits light or is relatively more light reflective than the adjustable dark portion of the adjustable shadow disk. Also, the adjustable shadow disk may be comprised of LCDs that are selectively adjustable to be light and dark. The light LCDs form the adjustable light portion of the adjustable shadow disk and dark LCDs form the adjustable dark portion of the adjustable shadow disk. The adjustable light portion of the adjustable shadow disk may be illuminated while the adjustable dark portion of the adjustable shadow disk is selectively masked from illumination.

In a preferred embodiment the geographical chronological device has an adjustable time pointer for selectively referencing a specific portion of the semi-transparent world map. The geographical chronological device may also have selectively removably attachable overlays and selectively removably attachable stickers for identifying specific locations on the semi-transparent world map. A clock crystal may be disposed adjacent the semi-transparent world map, which may be an etched portion of the clock crystal or a semi-transparent decal removably attached to the clock crystal.

BRIEF DESCRIPTION OF THE DRAWINGS

Further advantages of the invention will become apparent by reference to the detailed description of preferred embodiments when considered in conjunction with the figures, which are not to scale, wherein like reference numbers indicate like elements through the several views, and wherein.

DETAILED DESCRIPTION

Figure 1:
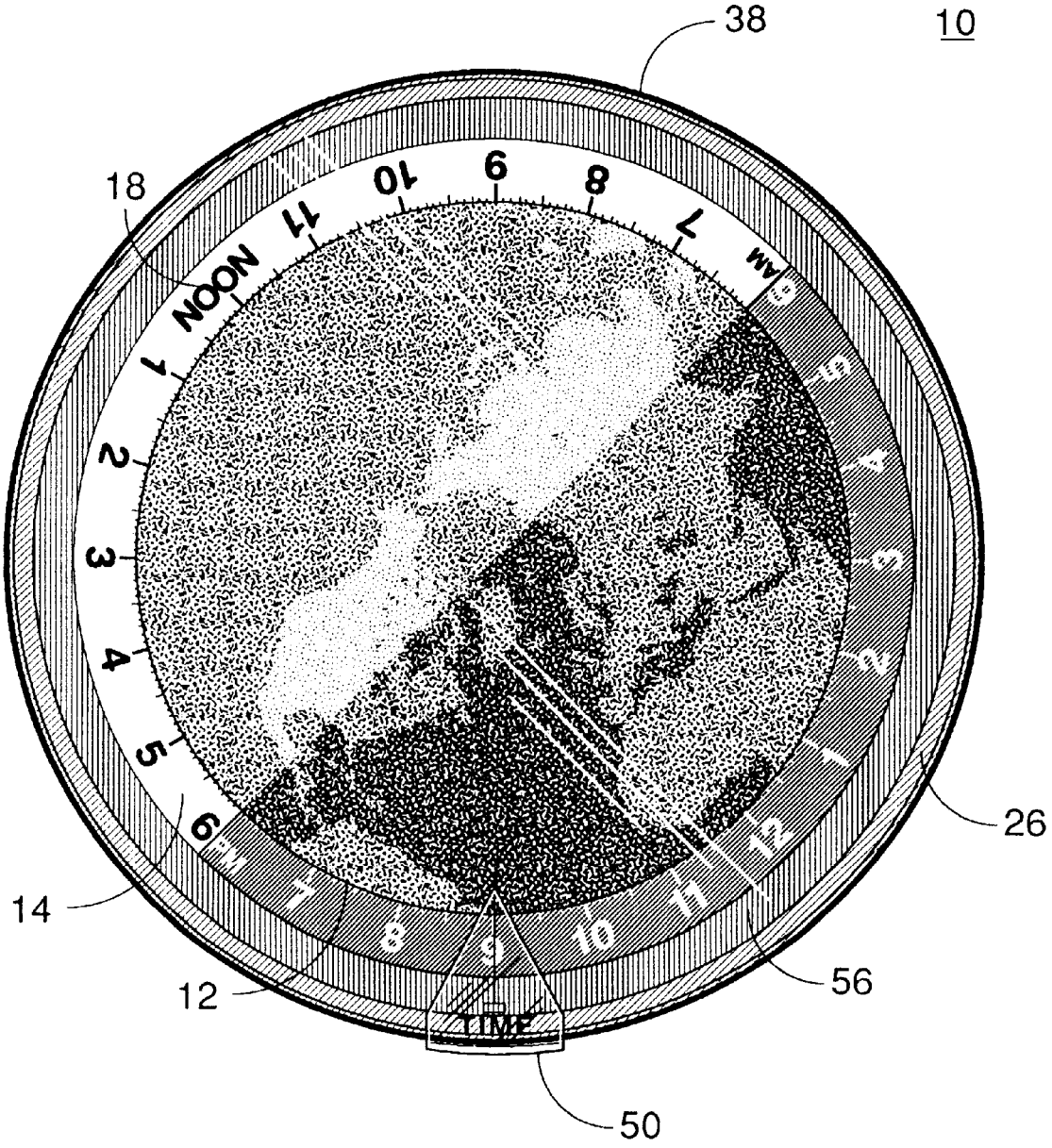
FIG. 1 is a top plan view of a geographical chronological device.

Referring now to FIG. 1, there is depicted a geographical chronological device, such as a clock 10. The clock 10 has a semi-transparent world map 12. The semi-transparent world map 12 does not pass light completely through it in an unrestricted fashion, and light that is transmitted through the semi-transparent world map 12 becomes somewhat distorted. In this manner, images viewed through the semi-transparent world map 12 appear somewhat hazy and the boundaries of such images tend to blur. Thus, similar appearing images that are bordering one another tend to appear continuous at their borders, as viewed through the semi-transparent world map 12.

The semi-transparent world map 12 depicts a view of the earth from a polar planetary projection of the north pole or south pole. There are no man-made boundaries depicted on the semi-transparent world map 12. However, large natural planetary features, such as oceans and continents, are depicted. These features may be color coded using typical colors, such as green for continents and blue for oceans. In some embodiments topographical information may be included as a part of the color coding, such as indicating the relative elevation of mountains and valleys by using different colors on the semi-transparent world map 12.

The semi-transparent world map 12 is preferably disposed on a clock crystal 56, and may take the form of a decal which is disposed on either the inside or the outside of the crystal 56. Alternately, the semi-transparent world map 12 may be etched into a portion of the material of the crystal 56. It will be appreciated that the term "crystal" is used in a descriptive sense, rather than a literal sense, and that the crystal 56 may be formed of any one of a number of essentially transparent and resilient materials, including glass, crystal, and appropriate plastics.

The semi-transparent world map 12 is depicted from a polar planetary projection. In other words, the semi-transparent world map 12 is preferably circular in shape, which is the shape of the projection of a sphere, such as a planet. Further, because it is a polar projection, one of the planetary poles, such as the north pole or south pole, is located essentially in the center of the circular projection. The areas of the planet corresponding to about the tropic of Capricorn or tropic of Cancer are located around the periphery of the circular projection. This orientation is selected for the semi-transparent world map 12 to more readily depict the relationship between the rotation of the earth, time, night and day, and variations in night and day according to changes in the seasons, which relationships are discussed more completely below.

As the earth moves in its orbit around the sun, its axis of rotation maintains a nearly constant orientation in space. The earth is inclined at an angle to the orbital plane. During the six-month half of each orbit when the north pole is generally inclined toward the sun, a point in the northern hemisphere receives the sun's rays at an angle closer to 90° than does a point in the southern hemisphere. This results in the northern hemisphere experiencing more hours of daylight than the southern hemisphere. Thus, this condition results in summer in the northern hemisphere, and winter in the southern hemisphere.

During the other six months, the north pole is generally inclined away from the sun, and a point in the southern hemisphere receives the sun's rays at an angle closer to 90° than does a point in the northern hemisphere. This results in the southern hemisphere experiencing more hours of daylight than the northern hemisphere. Thus, this condition results in summer in the southern hemisphere, and winter in the northern hemisphere.

In latitudes near the north pole or south pole, there tends to be continuous night for at least a portion of the winter and continuous day for at least a portion of the summer. Typically, there is at least one twenty-four-hour period of day and one twenty-four-hour period of night in every year. At the poles themselves, both day and night are theoretically six months long, though the actual periods of day and night tend to be modified by "twilight" periods.

In lower latitudes the effect of the tilt of the earth at the axis results in a general lengthening of daylight hours in summer and a general shortening of daylight hours in winter. Near the equator, the seasonal variation in day and night is not as significant. Concepts and principles such as these can be more easily visualized and taught with the clock 10, as described more completely below. By depicting a polar planetary projection on the semi-transparent world map 12, those areas of the planet which experience the greatest variation in the relative length of day and night from season to season are more prominently displayed, while those areas or the planet which experience relatively lesser variation in the relative length of day and night from season to season are not as prominently displayed.

Figure 3:
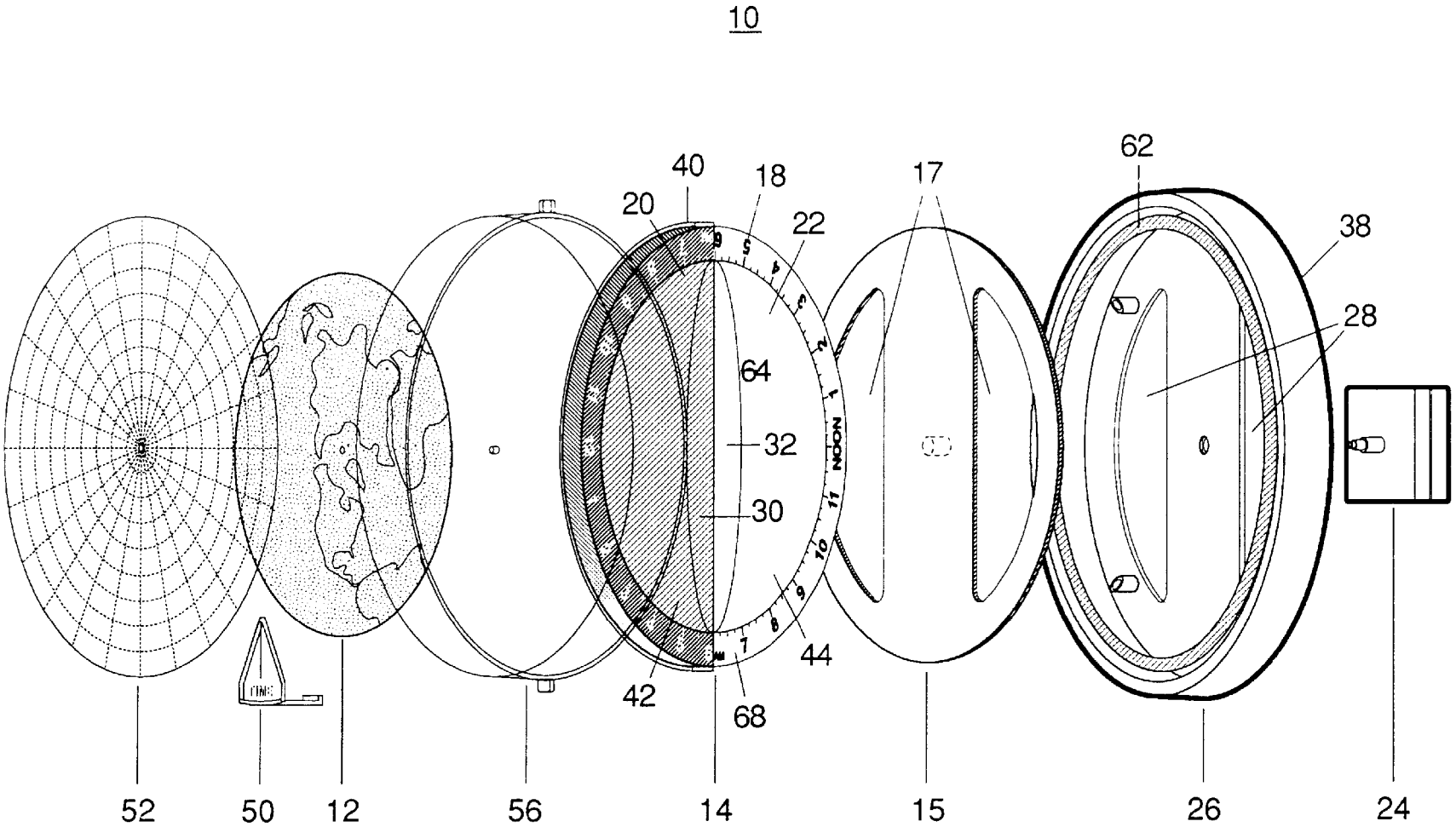
FIG. 3 is an exploded perspective view of the geographical chronological device.

In a preferred embodiment, the clock 10 has removably attachable overlays 52, depicted in FIG. 3, which removably attach to the semi-transparent world map 12 or the crystal 56. The overlays 52 may depict different geographic divisions, such as latitude, longitude, continents, political divisions, historical political divisions, country boundaries, cultural boundaries, language boundaries, temperature indications, agricultural information, population information, forestation information, and pollution information. The overlays 52 may provide instructional and teaching aids for a wide variety of topics including geography, biology, botany, zoology, history, social studies, and environmental issues. The overlays 52 are configured so that they can be quickly changed. This is especially advantageous to show historical progressions, such as changes in political boundaries, and for comparison and contrast studies, such as in temperature ranges and how they correlate to agricultural information.

In alternate embodiments the clock 10 has removably attachable stickers 54, also depicted in FIG. 3, which may be removably attached to the semi-transparent world map 12, or to the crystal 56. The stickers 54 indicate specific points of interest on the semi-transparent world map 12, such as "my" house, grandma's house, the Statue of Liberty, the Eiffel Tower, the Washington Monument, or the Parthenon.

The clock 10 has a clock housing 26. The housing 26 is a casing in which the clock 10 components may be contained and a support for displaying the clock 10. The housing 26 preferably has a lip 38 disposed about its perimeter, for hanging the clock 10 from a wall or a display stand. The housing 26 thus allows the clock 10 to be displayed in a number of ways. The housing 26 may be made out of any one of a number of suitable materials, such as plastic, metal, wood, or ceramic. The housing 26 may be shaped into a simple circular shape, which duplicates the general circular shape of the semi-transparent map 12, or alternately the housing 26 may be formed into other shapes.

The clock 10 has an adjustable shadow disk 14, disposed adjacent to and partly visible through the semi-transparent world map 12. The adjustable shadow disk 14 indicates which locations on the semi-transparent world map 12 are experiencing night, and which locations on the semi-transparent world map 12 are experiencing day. In addition, the adjustable shadow disk 14 is adjustable to depict variations in the relative lengths of day and night according to the change in seasons. The means by which this is accomplished are described more completely below.

The adjustable shadow disk 14 has time indicia 18 disposed about its periphery. The time indicia 18 indicate the time in a twenty-four hour format. In other words, the indicia 18 are disposed about the periphery of the adjustable shadow disk 14 so as to create twenty-four essentially equal divisions around the adjustable shadow disk 14, each division representing one hour of a twenty-four hour day. The indicia 18 may have two sets of numbers, such as Arabic or Roman numerals, being 1 through 12 inclusive, where the first set of twelve numbers corresponds to a.m. or morning hours, and the second set of twelve numbers corresponds to p.m. or evening hours. In an alternative embodiment, the time indicia 18 number 1 through 24 inclusive or 0 through 24 inclusive, similar to the manner in which military time is tracked.

Figure 2:
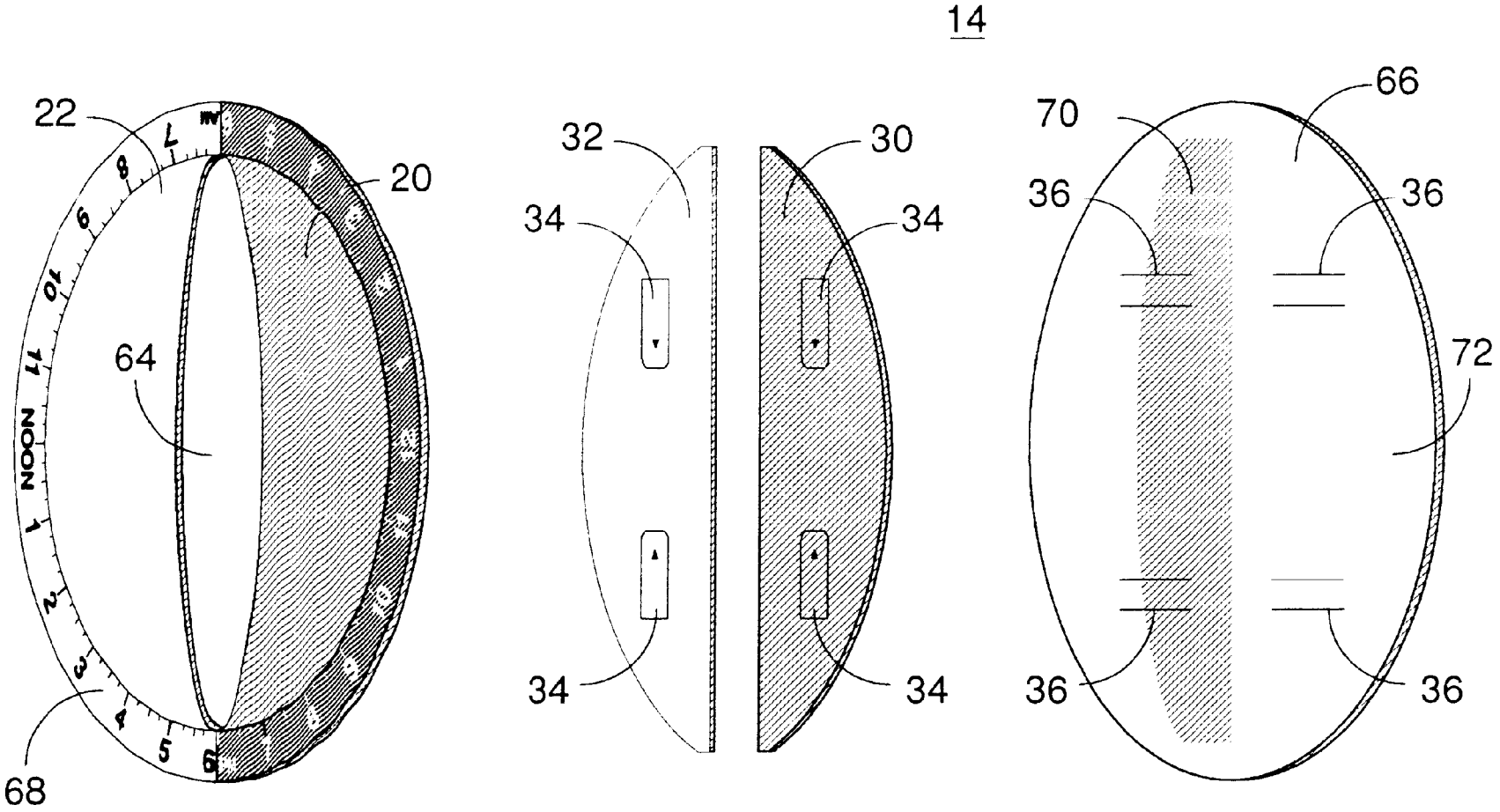
FIG. 2 is an exploded perspective view of an adjustable shadow disk.

Referring now to FIG. 2, the adjustable shadow disk 14 is seen to have several different pieces, including a front piece 68, a sliding light portion 32, a sliding dark portion 30, and a rear piece 66. The front piece 68 has a dark portion 20 and a light portion 22. In a similar fashion, the rear disk 66 has a dark portion 70 and a light portion 72. The dark portions 20, 30, and 70 form an adjustable dark portion 42 of the adjustable shadow disk 14. The light portions 22, 32, and 72 form an adjustable light portion 44 of the adjustable shadow disk 14. The adjustable dark portion 42 preferably has a color such as black or grey, and the adjustable light portion 44 preferably has a color such as white or silver. Thus, the adjustable dark portion 42 and the adjustable light portion 44 contrast one with the other. However, the adjustable dark portion 42 and the adjustable light portion 44 may be formed in ways other than by using contrasting colors, such as explained more completely hereafter.

In actual use, the front piece 68, sliding light portion 32, sliding dark portion 30, and rear piece 66 are laminated together to form an integral piece, which is the adjustable shadow disk 14. The method used to laminate the pieces 68, 32, 30, and 66 together will typically vary according to their composition. For example, if the pieces 68, 32, 30, and 66 are made of plastic, then they may be glued or melted together, or held together with fasteners such as screws or pegs. If the pieces 68, 32, 30, and 66 are made of paper or other fiber-based board, they may be glued or taped together. Of course, the pieces 68, 32, 30, and 66 may be formed of other suitable materials, as indicated below, which may offer other suitable methods of lamination.

The adjustable shadow disk is assembled such that the sliding dark portion 30 and the sliding light portion 32 are sandwiched between the front piece 68 and the rear piece 66. The sliding light portion 32 and the sliding dark portion 30 are not glued or adhered to the front piece 68 or the rear piece 66, but are free to slide between the front piece 68 and the rear piece 66. Thus, when it is said that the pieces 68, 32, 30 and 66 are laminated together, it will be understood that only the front piece 68 and the rear piece 66 are attached one to the other, and the sliding pieces 32 and 30 are held between the front piece 68 and the rear piece 66, such that the sliding pieces 32 and 30 are retained between the front piece 68 and the rear piece 66, but are free to slide between them.

The front piece 68 has an oval cut-out 64, through which the sliding dark portion 30, sliding portion 32, dark portion 70, and sliding light portion 72 are visible. The sliding light portion 32 is positioned between the front piece 68 and the rear piece 66 such that it can be slid to selectively cover or reveal the dark portion 70 of the rear piece 66. Likewise, the sliding dark portion 32 is positioned between the front piece 68 and the rear piece 66 such that it can be slid to selectively cover or reveal the light portion 72 of the rear piece 66.

The sliding dark portion 30 and the sliding light portion 32 have tabs 34 for sliding the sliding dark portion 30 and the sliding light portion 32. The tabs 34 fit through corresponding slits 36 in the rear piece 66 of the adjustable shadow disk 14. When the tabs 34 are inserted through the slits 36, the tabs 34 extend out of the other side of the rear piece 66, and are accessible from that other side. The sliding dark portion 30 and sliding light portion 32 are slid by grasping the tabs 34 exposed at the other side of the rear piece 66, and moving the tabs 34 within the slits 36.

The adjustable dark portion 42 and the adjustable light portion 44 adjust so that they can be relatively larger or relatively smaller one to the other. The adjustable dark portion 42 and adjustable light portion 44 are preferably continuously variable within a given range. In the preferred embodiment, this is accomplished by adjusting the relative positions of the sliding dark portion 30 and the sliding light portion 32. In this manner the adjustable dark portion 42 and the adjustable light portion 44 are used to indicate relatively greater or lesser night and day in different areas of the planet according to changes in the seasons. Because the shadow disk 14 is adjustable, the relative amounts of the adjustable light portion 44 and the adjustable dark portion 42 which are visible can vary.

The adjustable dark portion 42 of the adjustable shadow disk 14 is used to generally indicate night and the adjustable light portion 44 of the adjustable shadow disk 14 is used to generally indicate day. This is done by placing the adjustable shadow disk 14 near the semi-transparent world map 12 in such a fashion that the adjustable shadow disk 14 is viewed through the semi-transparent world map 12, as generally depicted in FIGS. 1 or 3. Because the semi-transparent nature of the semi-transparent world map 12 tends to somewhat diffuse the light which passes through it, as described above, the adjustable light portion 44 of the adjustable shadow disk 14, and the adjustable dark portion 42 of the adjustable shadow disk 14, each tend to take on a coherent and continuous appearance.

In other words, even though the adjustable dark portion 42 of the adjustable shadow disk 14 is comprised of three different interrelating dark elements, being the dark portions 20, 30, and 70, when viewed through the semi-transparent world map 12, the adjustable dark portion 42 of the adjustable shadow disk 14 appears to be a single dark portion. Similarly, even though the adjustable light portion 44 of the adjustable shadow disk 14 is comprised of three different interrelating light elements, being the light portions 22, 32, and 72, when viewed through the semi-transparent world map 12, the adjustable light portion 44 of the adjustable shadow disk 14 appears to be a single light portion.

The optimal distance by which the shadow disk 14 and the semi-transparent world map 12 are separated depends generally on how transparent the semi-transparent world map 12 is. For example, a distance of about 0.125 inches between the semi-transparent world map 12 and the shadow disk 14 works well in the preferred embodiment. With this distance, the different portions of the adjustable light portion 44 and the adjustable dark portion 42 cannot be readily identified as different portions, and tend to blend into a single adjustable dark portion 42 and a single adjustable light portion 44. If the distance between the adjustable shadow disk 14 and the semi-transparent world map 12 were reduced in this embodiment, the edges between the different portions of the adjustable light portion 44 and the adjustable dark portion 42 would be more readily seen, and the adjustable light portion 44 and the adjustable dark portion 42 would not appear to be so contiguous, which would tend to reduce the overall appearance of the clock 10.

Conversely, if the distance between the semi-transparent world map 12 and the adjustable shadow disk 14 were to be increased in this embodiment, the edges between the adjustable light portion 44 and the adjustable dark portion 42 would tend to blur and be less distinct as viewed from a distance, which again would tend to reduce the overall appearance of the clock 10.

Thus, the opacity of the semi-transparent world map 12 will affect the optimal spacing between it and the adjustable shadow disk 14. For those embodiments in which the semi-transparent world map 12 is relatively more transparent, the distance between the semi-transparent world map 12 and the adjustable shadow disk 14 is preferably relatively greater. For those embodiments in which the semi-transparent world map 12 is relatively less transparent, the distance between the semi-transparent world map 12 and the adjustable shadow disk 14 is preferably relatively smaller.

Those portions of the semi-transparent world map 12 which have the adjustable dark portion 42 behind them appear relatively dark. Those portions of the semi-transparent world map 12 which have the adjustable light portion 44 behind them appear relatively light. The relatively dark portions represent those portions of the planet, as depicted on the semi-transparent world map 12, which are experiencing night, and the relatively light portions represent those portions of the planet, as depicted on the semi-transparent world map 12, which are experiencing day. Thus, by changing the relative orientation between the semi-transparent world map 12 and the adjustable shadow disk 14, different portions of the planet, as depicted on the semi-transparent world map 12, can be depicted as having either day or night.

The adjustable dark portion 42 and adjustable light portion 44 of the adjustable shadow disk 14 are correlated to the indicia 18 disposed about the periphery of the adjustable shadow disk 14. Thus, those indicia 18 which are on the side of the adjustable shadow disk 14 that is primarily the adjustable dark portion 42, are generally night hours. These hours are preferably indicated on the adjustable shadow disk 14 from about 6 p.m. to about 6 a.m. In military time, it would be from about 1800 to about 0600. Similarly, those indicia 18 which are on the side of the adjustable shadow disk 14 that is primarily the adjustable light portion 44, are generally daylight hours. These hours are preferably indicated on the adjustable shadow disk from about 6 a.m. to about 6 p.m. In military time, it would be from about 0600 to about 1800.

Figure 4:
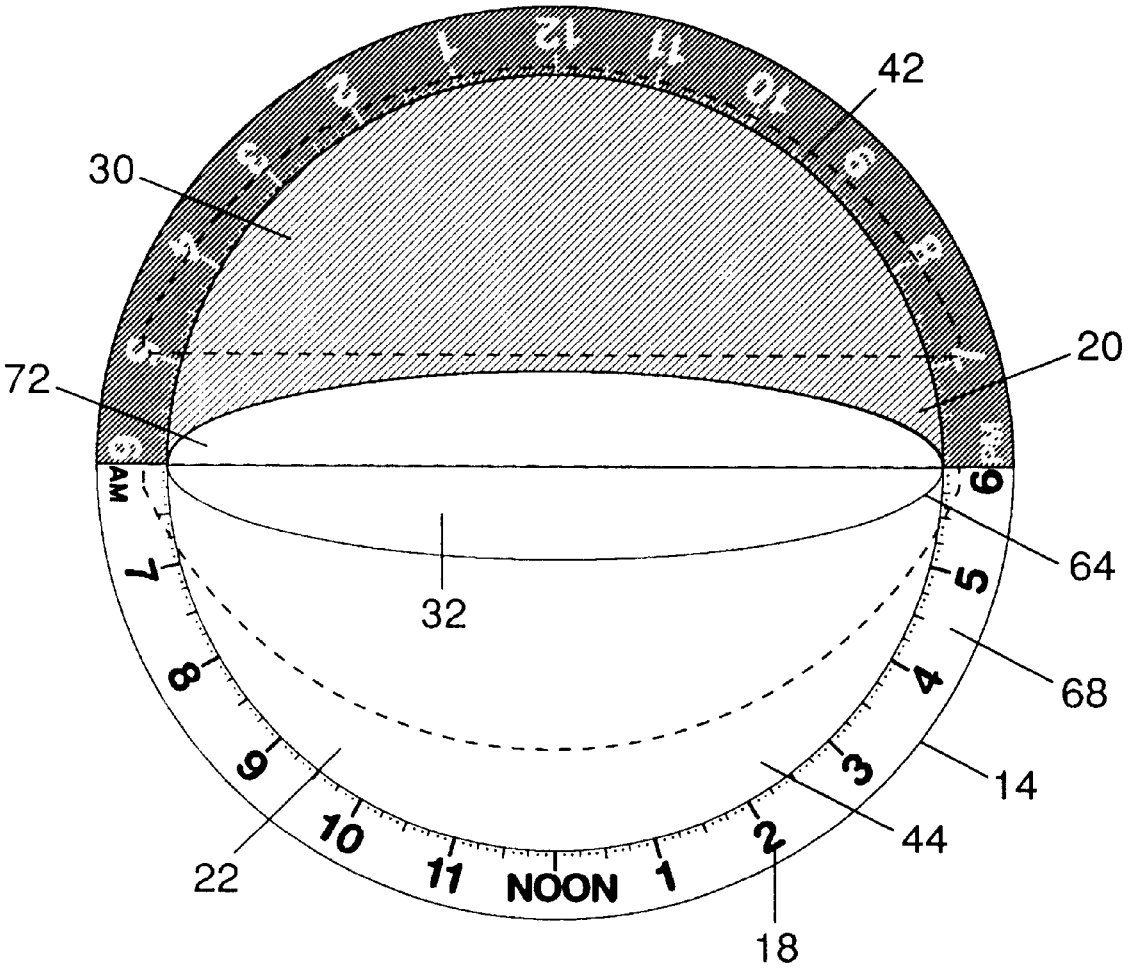
FIG. 4 is an adjustable shadow disk adjusted to indicate summer.

Referring to FIG. 4, the sliding dark portion 30 can be slid away from the center of the adjustable shadow disk 14 to reveal a greater portion of the light portion 72 of the rear piece 66, and the sliding light portion 32 can be slid toward the center of the adjustable shadow disk 14 to cover a greater portion of the dark portion 70 of the rear piece 66. When the sliding dark portion 30 and sliding light portion 32 are in this orientation, the adjustable light portion 44 is relatively larger than the adjustable dark portion 42. Thus, a greater portion of the shadow disk 14 appears to be light colored. Therefore, a greater portion of the semi-transparent world map 12 will be in front of the adjustable light portion 44, indicating a greater length of day, such as may prevail in the northern hemisphere during summer.

Figure 5:
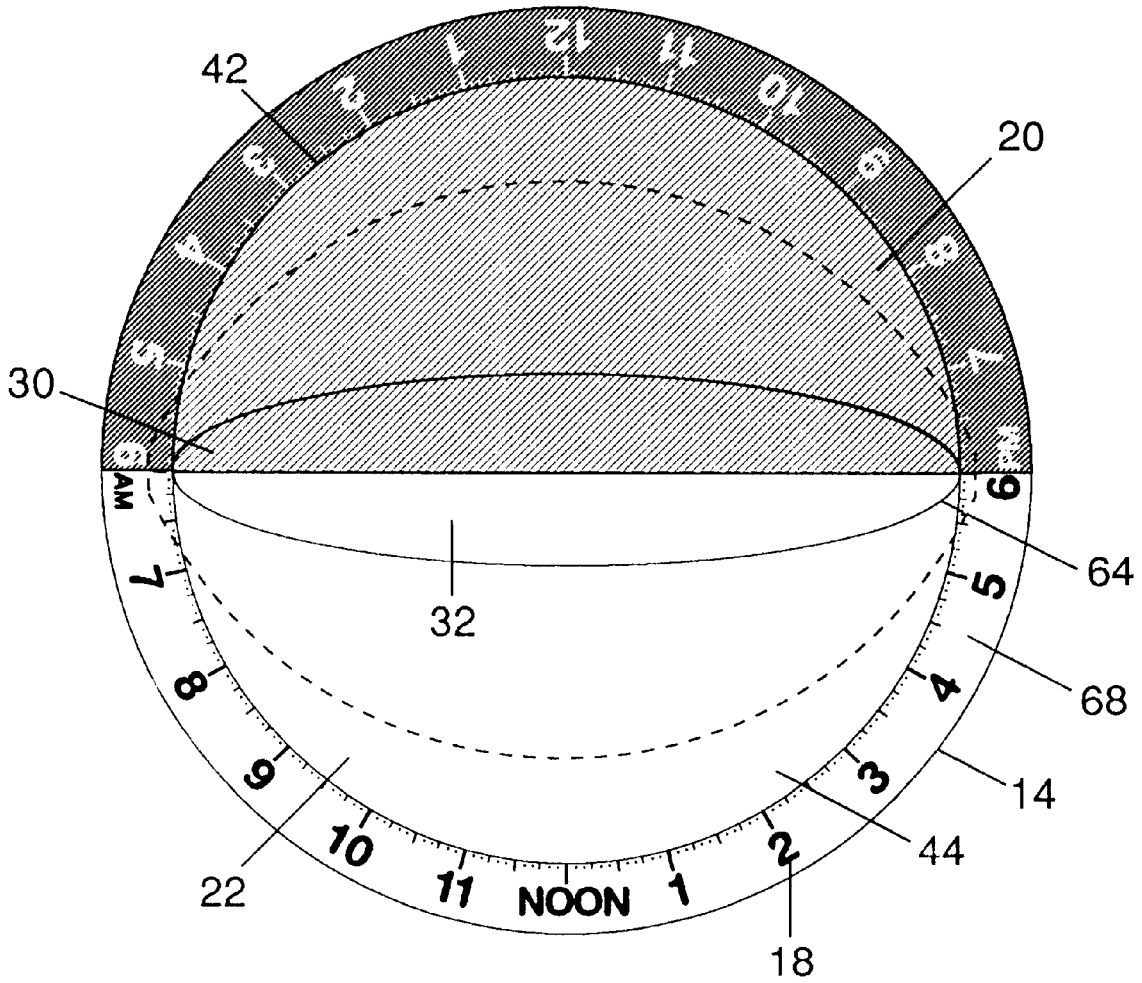
FIG. 5 is an adjustable shadow disk adjusted to indicate spring and fall.

Referring to FIG. 5, the sliding dark portion 30 can be slid toward the center of the adjustable shadow disk 14 to cover a greater portion of the light portion 72 of the rear piece 66, and the sliding light portion 32 can be slid toward the center of the adjustable shadow disk 14 to cover a greater portion of the dark portion 70 of the rear piece 66. When the sliding dark portion 30 and sliding light portion 32 are in this orientation, the adjustable light portion 44 is about the same relative size as the adjustable dark portion 42. Thus, an equal portion of the shadow disk 14 appears to be light colored, and an equal portion of the shadow disk 14 appears to be dark colored. Therefore, approximately half of the semi-transparent world map 12 will be in front of the adjustable light portion 44, and approximately half of the semi-transparent world map 12 will be in front of the adjustable dark portion 42, indicating a relatively equal length of day and night, such as may prevail in the northern hemisphere during spring or fall.

Figure 6:
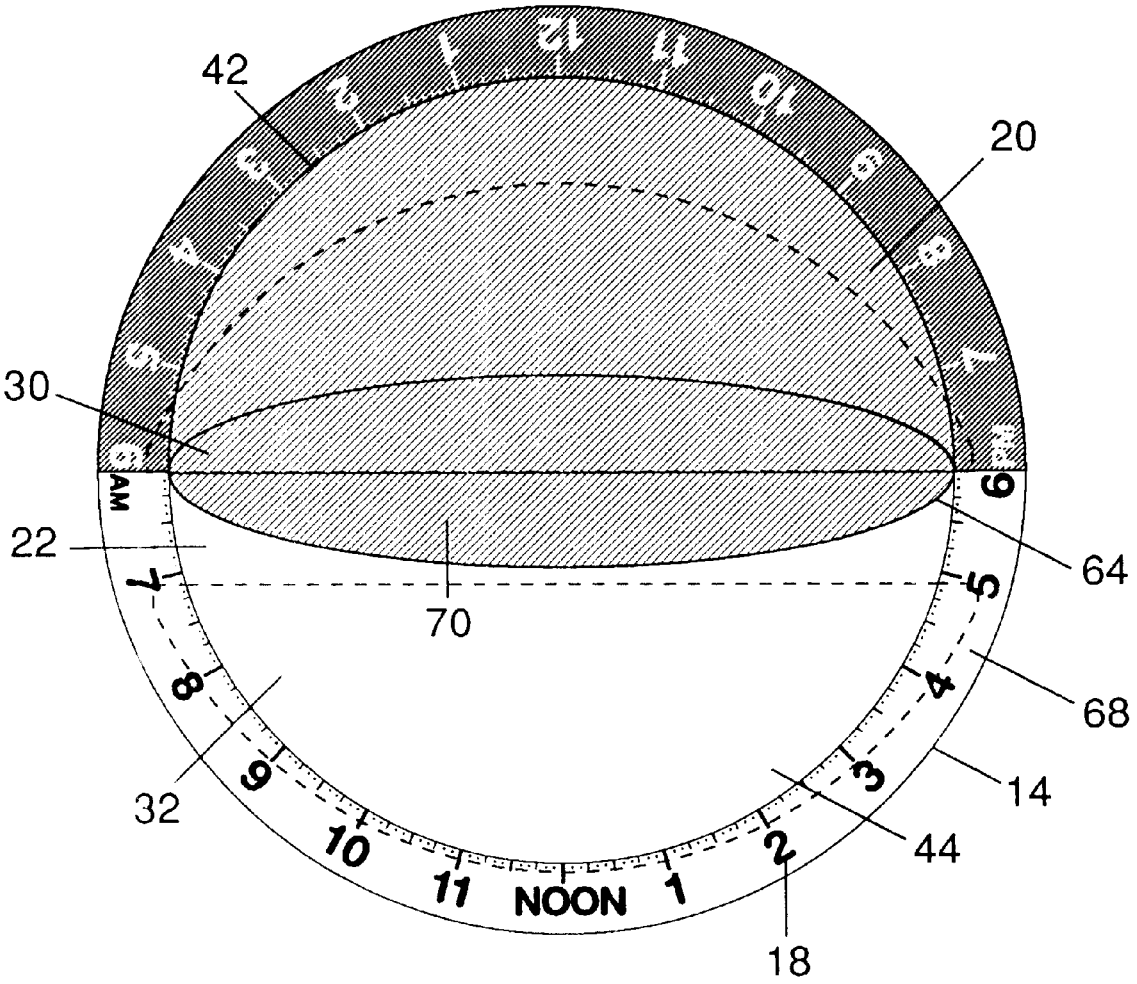
FIG. 6 is an adjustable shadow disk adjusted to indicate winter.

Referring to FIG. 6, the sliding dark portion 30 can be slid toward the center of the adjustable shadow disk 14 to cover a greater portion of the light portion 72 of the rear piece 66, and the sliding light portion 32 can be slid away from the center of the adjustable shadow disk 14 to reveal a greater portion of the dark portion 70 of the rear piece 66. When the sliding dark portion 30 and sliding light portion 32 are in this orientation, the adjustable light portion 44 is relatively smaller than the adjustable dark portion 42. Thus, a lesser portion of the shadow disk 14 appears to be light colored. Therefore, a lesser portion of the semi-transparent world map 12 will be in front of the adjustable light portion 44, indicating a lesser length of day, such as may prevail in the northern hemisphere during winter.

It will be appreciated that the sliding dark portion 30 and the sliding light portion 32 can be placed in positions other than those corresponding to all the way toward the center of the adjustable shadow disk 14 or all the way away from the center of the adjustable shadow disk 14. By adjusting the sliding dark portion 30 and the sliding light portion 32 to intermediate positions, the adjustable dark portion 42 and the adjustable light portion 44 can be adjusted to more accurately resemble the actual relative amounts of day and night during the year.

As depicted in FIG. 3, the housing 26 of the preferred embodiment has openings 28 through which the tabs 34 may be accessed. In this manner, the sliding dark portion 30 and the sliding light portion 32 may be selectively adjusted without removing the crystal 56 or the housing 26 from the adjustable shadow disk 14.

The adjustable light portion 44 is lit in a preferred embodiment, while the adjustable dark portion 42 is shielded from the light. Thus, the contrast between the adjustable light portion 44 and the adjustable dark portion 42 is provided by an element other than, or in addition to, color. The adjustable light portion 44 may be lit by a light 62 disposed about the perimeter of the housing 26, as depicted in FIG. 3. The light 62 illuminates the adjustable shadow disk 14, and may be a fluorescent or neon light, for example, which is conformable to the shape of the periphery of the housing 26 and adjustable shadow disk 14. The adjustable dark portion 42 is shielded from the light 62 by a light shield 40 disposed about the periphery of the adjustable shadow disk 14. The adjustable light portion 44 may be made of a light reflective material, and the adjustable dark portion 42 may be made of a light absorptive material, which would tend to increase the contrast between the adjustable light portion 44 and the adjustable dark portion 42.

In a related alternate embodiment, the light 62 is a black light, the adjustable light portion 44 is made of a material which fluoresces in black light, and the adjustable dark portion 42 is made of a material which does not fluoresce in black light. Thus, the adjustable light portion 44 will fluoresce in the black light, and the adjustable dark portion 42 will not, which will again tend to heighten the contrast between the adjustable light portion 44 and the adjustable dark portion 42.

In yet another embodiment, the adjustable light portion 44 is made of a light emitting material, such as a phosphorescent material which glows in the dark. The adjustable dark portion 42 is not made of a light emitting material. Thus, the adjustable light portion 44 will glow, and the adjustable dark portion 42 will not, again tending to heighten the contrast between the adjustable light portion 44 and the adjustable dark portion 42.

In a further related embodiment, the adjustable light portion 44 and the adjustable dark portion 42 are both made of light emitting devices, such as LED's. A portion of the LED's can be energized so that they emit light, and another portion of the LED's are not energized, and thus do not emit light. The energized portion of the LED's are the adjustable light portion 44 of the adjustable shadow disk 14, and the non energized portion of the LED's are the adjustable dark portion 42 of the adjustable shadow disk 14. Thus, as the seasons change from spring to summer to autumn to winter, the number of energized LED's changes relative to the number of non energized LED's, thus creating a continuously larger or smaller adjustable light portion 44 relative to the adjustable dark portion 42.

In another embodiment, the adjustable light portion 44 and the adjustable dark portion 42 of the adjustable shadow disk 14 are both made of LCD's which are dark when energized, such that they cannot readily pass light, and clear when non energized, such that light can pass through them. A reflective surface can be placed behind the LCD's, such that light is reflected from the reflective surface through the non energized LCD's, and light is not reflected from the reflective surface behind the energized LCD's. Alternately, a light may be placed behind the adjustable shadow disk 14, such that the light is transmitted through the non energized LCD's and the light is blocked by the energized LCD's. In these embodiments, the energized portion of the LCD's are the adjustable dark portion 42 of the adjustable shadow disk 14, and the non energized portion of the LCD's are the adjustable light portion 42 of the adjustable shadow disk 14. Thus, as the seasons change from spring to summer to autumn to winter, the number of energized LCD's changes relative to the number of non energized LCD's, thus creating a continuously larger or smaller adjustable light portion 44 relative to the adjustable dark portion 42.

A hub 15 is preferably attached to the rear piece 66 of the adjustable shadow disk 14. The hub 15 provides support for the adjustable shadow disk 14, which is preferably constructed of paper. The hub 15 has cut-out sections 17 through which the tabs 34 can be accessed.

A clock movement 24 is attached to the hub 15, and provides relative movement between the semi-transparent world map 12 and the adjustable shadow disk 14. The clock movement 24 is preferably a twenty-four-hour movement, so that the adjustable shadow disk 14 completes one full rotation relative to the semi-transparent world map 12 every twenty-four hours. Thus, the speed of rotation of the adjustable shadow disk 14 relative to the semi-transparent world map 12 is essentially equivalent to the speed of rotation of the earth relative to the sun.

The clock movement 24 rotatably attaches to the housing 26 so that the clock movement 24 may be selectively rotated relative to the clock housing 26. In this manner the adjustable shadow disk 14 may be rotated relative to the semi-transparent world map 12 at a rate that is faster than the normal movement of the twenty-four-hour clock movement 24. In this manner, the clock 10 can be quickly adjusted to different positions, so that it can be used for teaching, instructional, and demonstrational purposes.

An adjustable time pointer 50 may be attached to the periphery of the housing 26, and points to a location at the periphery of the adjustable shadow disk 14 in the region where the time indicia 18 are located. The adjustable time pointer 50 may also be made of a material which fluoresces, glows, or reflects light, so as to be more readily seen in contrast to the clock housing 26. The adjustable time pointer 50 can be repositioned about the perimeter of the housing 26. Thus, to set the clock 10 for use as a time-piece, an orientation is selected for the clock 10, such as by hanging it from the lip 38 from a nail on a wall. The adjustable time pointer 50 is attached to the periphery of the housing 26 at a convenient location, such as at the bottom of the clock 10, pointing toward the center of the clock 10.

The clock movement 24 is placed in a default position, such as within an indentation, bumps, or scoring on the housing 26. This is done so that if the clock movement 24 is later rotated relative to the housing 26, as described more completely above, the clock movement 24 may be readily returned to the default position so that the clock 10 may once again be used as a time piece. The clock movement 24 is then adjusted, using a movement-adjust knob or wheel on the clock movement 24, until the correct time, as indicated on the indicia 18 disposed at the periphery of the adjustable shadow disk 14, is displayed adjacent the adjustable time pointer 50. By "correct time" it is meant that time which is correct for the region of the semi-transparent world map 12 disposed adjacent to and essentially in-line with the adjustable time pointer 50 and the indicia 18.

Once the clock 10 has been set up, as described above, the relative positions of the semi-transparent world map 12 and the adjustable shadow disk 14 accurately indicate which portions of the planet, as depicted on the semi-transparent world map 12, are experiencing night, and which portions of the planet, as depicted on the semi-transparent world map 12, are experiencing day. As the clock movement 24 rotates the adjustable shadow disk 14 relative to the semi-transparent world map 12, the portions of the semi-transparent world map 12 which are backed by the adjustable dark portion 42 and the adjustable light portion 44 change, indicating those portions of the planet which are newly experiencing night and day respectively. Thus, the clock 10 may be used to quickly determine not only the local time, and the time in other parts of the planet depicted in the semi-transparent world map 12, but can also be used to quickly determine which portions of the planet are experiencing either night or day.

While specific embodiments of the invention have been described with particularity above, it will be appreciated that the invention comprehends many rearrangements and substitution of parts without departing from the scope of the invention.

What is claimed is:

1. A geographical chronological device comprising:

a semi-transparent world map depicting a polar planetary projection, an adjustable shadow disk disposed adjacent to and partly visible through the semi-transparent world map, the adjustable shadow disk having;

a periphery, time indicia disposed about the periphery, an adjustable dark portion to indicate night, and an adjustable light portion to indicate day, the dark and light portions adjustable to indicate relatively greater and lesser night and day according to seasons, and a clock movement for providing relative movement between the semi-transparent world map and the adjustable shadow disk.

2. The geographical chronological device of claim 1 further comprising a clock housing having a perimeter.

3. The geographical chronological device of claim 2 wherein the adjustable shadow disk further comprises sliding portions for selectively adjusting the adjustable light portion and the adjustable dark portion, the sliding portions connected to tabs for selectively sliding the sliding portions, to indicate relatively greater and lesser night and day according to seasons, and the clock housing having openings for accessing the tabs.

4. The geographical chronological device of claim 2 wherein the clock housing further comprises a lip for removably hanging the geographical chronological device.

5. The geographical chronological device of claim 2 wherein the clock movement is rotatably attached to the clock housing, for selectively rotating the clock movement relative to the clock housing, to quickly adjust times for teaching, instructional and demonstrational purposes.

6. The geographical chronological device of claim 2 further comprising a light disposed within the clock housing and at the perimeter of the clock housing for providing light to the adjustable shadow disk.

7. The geographical chronological device of claim 6 wherein the adjustable shadow disk further comprises a light shield disposed about at least a portion of the periphery of the adjustable shadow disk, the light shield selectively blocking the light provided to the adjustable dark portion of the adjustable shadow disk, and selectively passing the light provided to the adjustable light portion of the adjustable shadow disk.

8. The geographical chronological device of claim 1 wherein the adjustable shadow disk further comprises sliding portions for selectively adjusting the adjustable light portion and the adjustable dark portion, the sliding portions connected to tabs for selectively sliding the sliding portions.

9. The geographical chronological device of claim 1 wherein the adjustable light portion of the adjustable shadow disk is illuminated and the adjustable dark portion of the adjustable shadow disk is selectively masked from illumination.

10. The geographical chronological device of claim 1 wherein the adjustable light portion of the adjustable shadow disk emits light.

11. The geographical chronological device of claim 1 wherein the adjustable light portion of the adjustable shadow disk is relatively more light reflective than the adjustable dark portion of the adjustable shadow disk.

12. The geographical chronological device of claim 1 wherein the adjustable shadow disk further comprises LCDs, the LCDs being selectively adjustable to be light and dark, the light LCDs forming the adjustable light portion of the adjustable shadow disk and the dark LCDs forming the adjustable dark portion of the adjustable shadow disk.

13. The geographical chronological device of claim 1 further comprising an adjustable time pointer for selectively referencing a specific portion of the semi-transparent world map.

14. The geographical chronological device of claim 1 further comprising selectively removably attachable overlays.

15. The geographical chronological device of claim 1 further comprising selectively removably attachable stickers for identifying specific locations on the semi-transparent world map.

16. The geographical chronological device of claim 1 further comprising a clock crystal disposed adjacent the semi-transparent world map.

17. The geographical chronological device of claim 16 wherein the semi-transparent world map further comprises a semi-transparent decal removably attached to the clock crystal.

18. The geographical chronological device of claim 16 wherein the semi-transparent world map further comprises an etched portion of the clock crystal.

19. A geographical chronological device comprising:

a clock housing, a semi-transparent world map depicting a polar planetary projection, an adjustable shadow disk disposed adjacent to and partly visible through the semi-transparent world map, having a periphery and time indicia disposed about the periphery, and having an adjustable dark portion to indicate night and an adjustable light portion to indicate day, the dark and light portions adjustable to indicate relatively greater and lesser night and day according to seasons, a clock movement for providing relative movement between the semi-transparent world map and the adjustable shadow disk, the clock movement rotatably attached to the clock housing, for selectively rotating the clock movement relative to the clock housing, to quickly adjust times for teaching, instructional and demonstrational purposes, a clock crystal disposed adjacent the semi-transparent world map, and the semi-transparent world map being a semi-transparent decal removably attached to the clock crystal.

20. A geographical chronological device comprising:

a clock crystal, a semi-transparent world map decal depicting a polar planetary projection, removably attached to the clock crystal, an adjustable shadow disk disposed adjacent to and partly visible through the semi-transparent world map, having a periphery and time indicia disposed about the periphery, and having an adjustable dark portion to indicate night and an adjustable light portion to indicate day, the dark and light portions adjustable to indicate relatively greater and lessor night and day according to seasons, the adjustable shadow disk having sliding portions for selectively adjusting the adjustable light portion and the adjustable dark portion, the sliding portions connected to tabs for selectively sliding the sliding portions, a clock movement for providing relative movement between the semi-transparent world map and the adjustable shadow disk, the clock movement rotatably attached to the clock housing, for selectively rotating the clock movement relative to the clock housing, to quickly adjust times for teaching, instructional and demonstrational purposes, a clock housing having, a lip for removably hanging the geographical chronological device, and openings for accessing the tabs, an adjustable time pointer for selectively referencing a specific portion of the semi-transparent world map, selectively removably attachable overlays, and selectively removably attachable stickers for identifying specific locations on the semi-transparent world map.

* * * * *